United States Patent [19]

Friesen et al.

[11] Patent Number: 4,780,046

[45] Date of Patent: Oct. 25, 1988

[54] LATCHING MECHANISM FOR A LOADER

[75] Inventors: Henry Friesen, Niagara Falls; Fredrick G. Tischler, St. Anns, both of Canada

[73] Assignee: Deere & Company, Moline, Ill.

[21] Appl. No.: 73,602

[22] Filed: Jul. 15, 1987

[51] Int. Cl.[4] ..... B66C 3/02

[52] U.S. Cl. ..... 414/686; 403/374

[58] Field of Search ..... 414/686, 685; 172/272-275; 403/374, 409.1

[56] References Cited

U.S. PATENT DOCUMENTS

| | | | |
|---|---|---|---|
| 3,324,954 | 6/1967 | Westendorf | 172/1 |
| 3,991,890 | 11/1976 | Frank | 214/131 A |
| 4,033,469 | 7/1977 | Frank | 214/131 A |
| 4,674,798 | 6/1987 | Oeth et al. | 297/411 |

FOREIGN PATENT DOCUMENTS

| | | | |
|---|---|---|---|
| 924679 | 4/1973 | Canada | 414/686 |
| 1248551 | 8/1967 | Fed. Rep. of Germany | 414/686 |
| 2295907 | 7/1976 | France | 414/686 |

*Primary Examiner*—Robert J. Spar
*Assistant Examiner*—Donald W. Underwood

[57] ABSTRACT

Cable operated locking structure permitting an operator to lock and unlock the front of a loader without leaving the tractor seat. An eccentric cam and a cam operating wedge are secured on a front end assembly which also includes a mounting stand arrangement. A front mounting frame is connected to the tractor frame and includes a stop member which engages a guide member located on the assembly. The guide member and stop member secure the mast arm in the transverse and vertical directions, and the cam is movable into a cavity area on the front mounting frame to secure the mast arms in the downward and forward directions. Since the locking structure and parking stand are a single assembly, the loader can be offered either with or without the locking structure and parking stand features.

18 Claims, 5 Drawing Sheets

Fig. 1
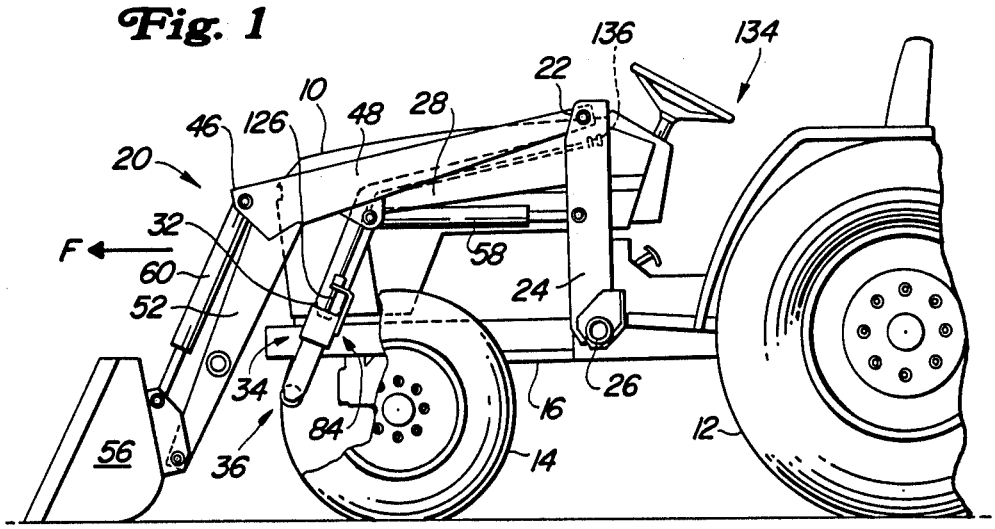
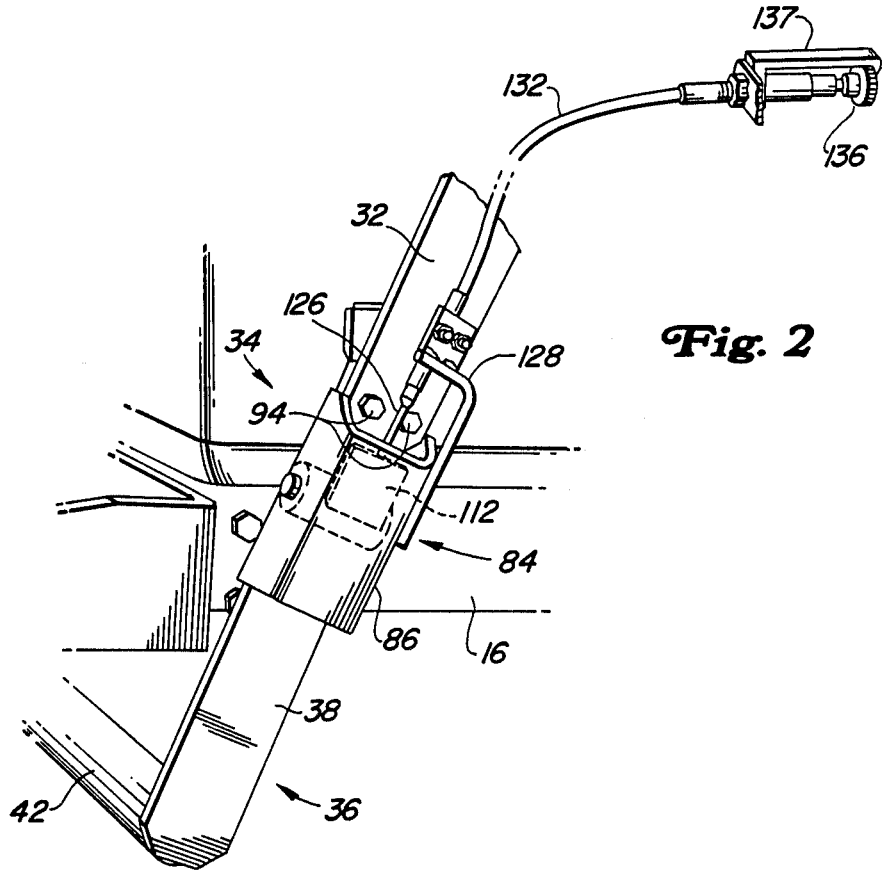
Fig. 2

Fig. 7
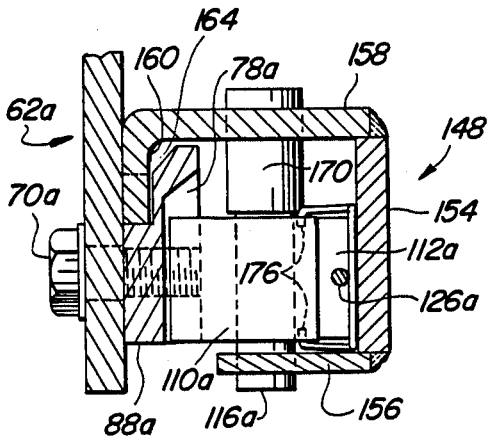
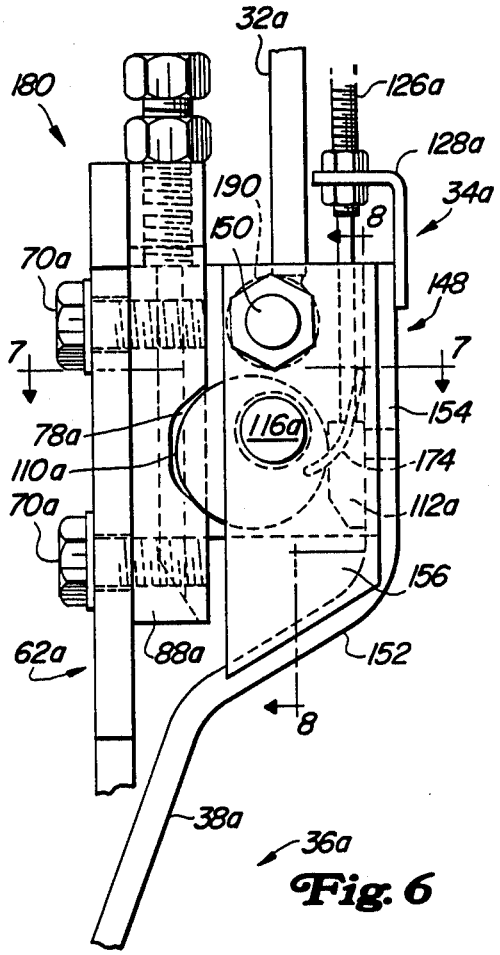
Fig. 6
Fig. 8
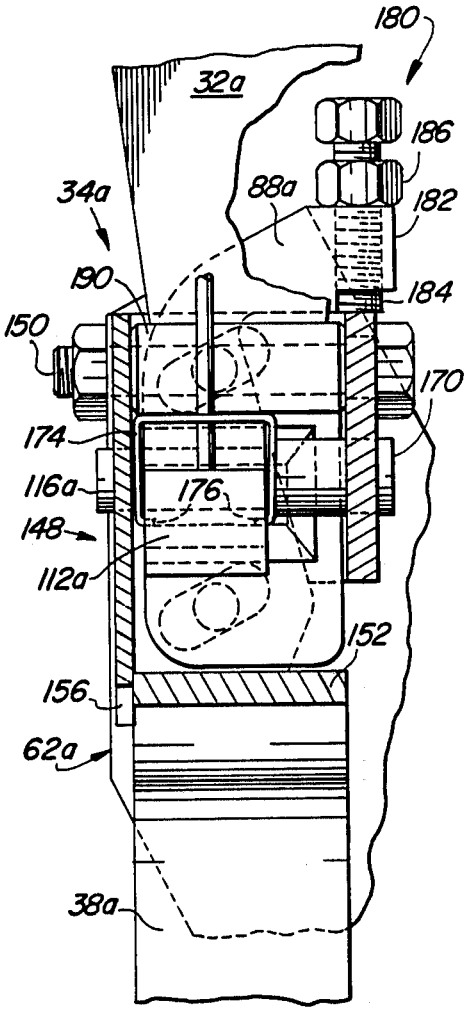

LATCHING MECHANISM FOR A LOADER

BACKGROUND OF THE INVENTION

The present invention relates generally to front end loaders adapted for mounting on a tractor, and more specifically to a remotely operable latching mechanism for such structure.

Numerous systems exist for attaching a front end loader to the frame of a tractor. To maintain the versatility of the tractor, the front end loader must be easily and quickly removable from and installable on the tractor. Many of these systems require the operator to leave the tractor cab several times during mounting or dismounting of the loader. Some types of loader mounts utilize loose pins or separate parking stands which must be stored between operations and which may be lost or misplaced. Although numerous systems are available which eliminate separate pins, connectors and parking stands, many of these are complex, bulky or difficult to mount or adjust. The connecting structure is usually made an integral part of the overall loader structure so that a substantial loader redesign effort is necessary to eliminate the optional quick mount or an integral parking stand arrangement. For example, a farmer who maintains his loader on the tractor year round does not want the added expense of a quick mount system with a parking stand.

BRIEF SUMMARY OF THE INVENTION

It is therefore an object of the present invention to provide an improved mounting structure for a front end loader. It is a further object to provide such a structure which reduces the number of trips an operator has to make off the tractor to connect or disconnect the loader.

It is a further object of the present invention to provide an improved loader mounting arrangement having a remotely operable forward latching system which allows the operator to lock and unlock the front of the loader from the tractor cab.

It is yet another object of the present invention to provide an improved latching structure for a front end loader which eliminates loose parts such as mounting pins and parking stands. It is yet another object to provide such a structure which may be operated from a remote location to thereby speed mounting and dismounting operations. It is still another object to provide such a structure which may be added as a separate unit to the base loader machine to thereby maintain the cost of the base loader as low as possible while still providing the latching and stand option to those desiring such features.

It is yet another object of the present invention to provide improved guide and latching structure for connecting the forward end of loader mast arms to the frame of a tractor. It is a further object to provide such a structure having a stop for retaining the mast arms in the up and transverse directions, and including latching structure for retaining the arms in the down and forward directions. It is yet a further object to provide such a structure wherein the latching parts are attached to the parking stand to minimize the cost of the base machine.

Latching structure is connected to the forward ends of mast arms which are connected to upiight mast posts of a loader frame. The mast posts are rockably connected to rear support structure on the tractor, and the mast arms can be rocked about the rear support structure between a lowered parking position and the raised attached position. A front mounting bracket is connected to the tractor frame and guides the front end of the mast arm against a stop as the mast is raised toward the mounted position. A cylindrical cam is rotatably mounted at the forward end of the mast arm and is extended into a cavity on the front mounting bracket by pushing a wedge behind the cam. The cam is eccentric and is rotated on a pin against the cavity to retain the mast arm in the down and forward directions. The mounting bracket retains the mast arm in the up and side-to-side directions. A cable is operably connected to the wedge so that the operator may latch or unlatch the structure remotely at the operator's station. Most of the parts of the latching mechanism are included in a parking stand which is attached to the front end of the mast. The parking stand, along with the latching parts, may be removed from the loader so that the loader may be offered to a purchaser without the parking stand and remote operating latch features. The remote latching feature reduces the number of trips off the tractor the operator must make during parking and mounting of the loader. The structure also obviates need for a separate parking stand or separate mounting bolts or the like.

These and other objects, features and advantages of the present invention will become apparenttto those skilled in the art from the description which follows and from the drawings.

BRIEF DESCRIPTION OF THE DRAWINGS

FIG. 1 is a side view of a tractor with the loader of the present invention attached thereto.

FIG. 2 is an enlarged perspective view of the forward end of the mast structure on the loader of FIG. 1.

FIG. 6 is a front enlarged view of a second embodiment of the latching structure.

FIG. 7 is a view taken substantially along lines 7—7 of FIG. 6.

FIG. 8 is a view taken substantially along lines 8—8 of FIG. 6.

DESCRIPTION OF THE PREFERRED EMBODIMENT

Figure 3:
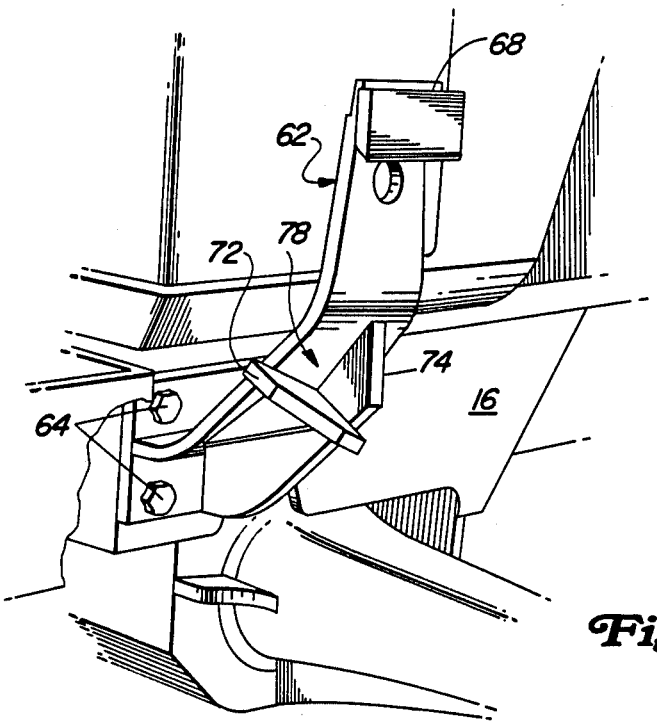
FIG. 3 is an enlarged front perspective view of one embodiment of the forward mounting bracket connected to the front end of the tractor.

Referring to FIG. 1, there is shown a tractor 10 supported by rear wheels 12 and front wheels 14 for forward movement (F) over the ground. The tractor 10 includes a main frame 16 supporting a front end loader indicated generally at 20. The loader 20 is generally symmetrical about an upright, fore-and-aft extending plane, and includes a mast 22 having rear upright mast posts 24 with lower ends supported on rear support structure 26 connected to the tractor frame 16.

A forwardly extending mast arm 28 is connected at its aft end to the mast post 24 and extends forwardly and downwardly therefrom to a forward end 32. The forward end 32 is releasably secured to the tractor frame 16 by front support structure 34 to be described in detail below. A parking stand 36 includes side legs 38 extending downwardly from the respective forward mast ends 32, and a bight portion 42 connects the lower ends of the side legs 38.

The loader 20 includes a boom 46 having rear boom arms 48 pivotally connected to the upper ends of the mast posts 24. A forward boom arm 52 extends downwardly from each arm 48 to a lower end which pivotally connects a bucket 56 or other earth engaging implement. A lift cylinder 58 is connected between each mast post 24 and the rear boom arm 48. A bucket cylinder 60 is connected between the forward end of the boom arm 48 and the bucket 56. The cylinders 58 and 60 are connected to conventional hydraulic circuitry (not shown) for operating the boom 46 and the bucket 56 and for rocking the loader 20 between a mounted position (FIG. 1) and a parked position (not shown) wherein the parking stand 36 rests on the ground. During mounting and dismounting of the loader 20, the lower ends of the mast posts 24 rest on the corresponding rear supports 26 and are pivoted about the rear supports 26 by actuating the cylinder 58 and/or the cylinder 60. Preferably, the rear support 26 is of the type shown and described in co-pending application Serial No. 073,601, filed concurrently herewith, of Nicholas Hamm and of common ownership with the present invention. The rear support 26 automatically locks and firmly secures the mast 22 to the tractor frame as the mast is rotated in the clockwise direction (as viewed in FIG. 1) from a parked position wherein the parking stand 36 is in contact with the ground.

The front support structure 34 includes a front mounting frame 62 connected to the forward end of the tractor frame 16 by bolts 64. The frame 62 extends outwardly and upwardly from the frame 16 to an upper end supporting a stop member 68 which is connected to the frame by a bolt 70. A pad 72 which angles upwardly in the forward direction is welded to the frame 62 below the stop member 68. An upright plate 74 is connected to the aft end of the pad 72 to define a cavity or cam-receiving area indicated generally at 78 extending inwardly from the outermost surface of the mounting frame 62.

Locking structure 84 is connected to the forward end 32 of the mast arm 28 and includes an inwardly opening, channel-shaped member 86. The lower end of the channel-shaped member 86 is connected to the side leg 38 of the parking stand 36. An upright guide member 88 is connected between the sides of the member 86 and is offset above the upper end of the side leg 38 to define an opening 92. The locking structure 84 is connected to the end 32 by a pair of bolts 94 extending through the end 32 and threaded into the guide member 88. The guide member 88 extends upwardly from the bolt area 94 to an upper end which is notched at 96 to define a groove between the guide member 88 and the inside surface of the mast end 32. The lower end of the stop member 68 includes complementary structure for receiving the grooved end of the guide member 88 as the mast 22 is rotated upwardly about the rear supports 26. The bottom surface 98 of the stop member 68 angles upwardly at approximately 45 degree angle from the outside edge to a vertical wall 102 which defines a notch 106 between the stop member 68 and the outermost surface of the frame 62. As the mast 22 is raised, the angled surface 98 guides the projection at the top of the guide member 88 into the notch 106. The guide member 88 then bottoms against the stop member 68 as the mast 22 reaches the mounted position. The guide member 88 and stop member 68 cooperate to prevent lateral movement and vertical movement of the mast arm 28.

Figure 4:
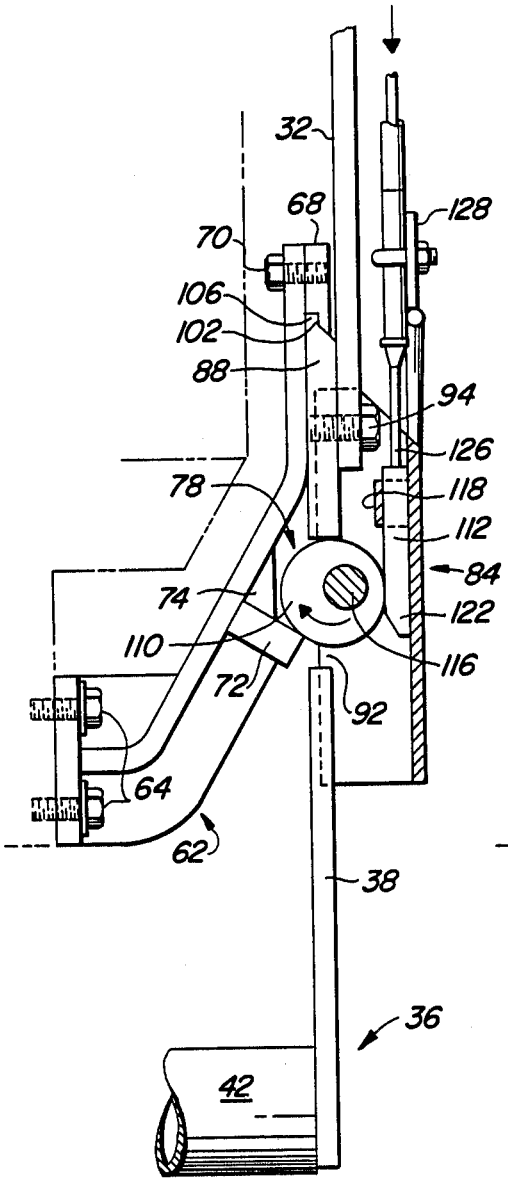
FIG. 4 is a front enlarged view of one embodiment of the invention, partially in section, showing the forward end of the mast arm in the raised position with the cam actuated to latch the mast arm to the tractor frame.
Figure 5:
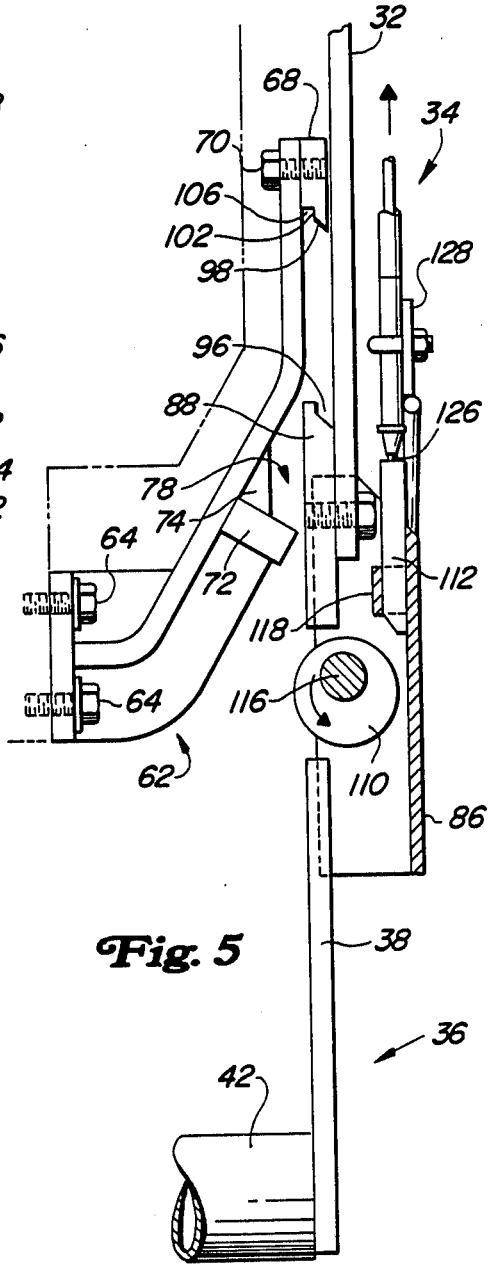
FIG. 5 is a view similar to FIG. 4 but showing the cam in the released position with the forward end of the mast arm below the upwardmost rocked position.

To lock the mast arm to the tractor frame and to prevent downward and forward movement of the mast arm with respect to the frame, a wedge operated cam 110 is pivotally secured to the channel-shaped member 86 adjacent the opening 92 for rocking into the cavity or cam-receiving area 78 (FIG. 4). A wedge 112 is slidably mounted against the bight portion of the member 86 for urging the cam 110 into the cavity 78 and for maintaining the cam within the cavity while the loader 20 is mounted on the tractor 10. As shown in FIGS. 4 and 5, the cam 110 is a cylindrical member and is pivotally connected to the sides of the channel-shaped member 86 by a pivot pin 116 at a location offset above the cylindrical axis of the cam 110. In the unlocked position (FIG. 5) the cam 110 is generally contained within the channel-shaped member 86 to permit free movement of the forward end 32 of the mast arm to and from the mounted position. In the unlocked position, the cam 110 is offset slightly from the bight portion of the channel-shaped member 86. The wedge 112 is slidably secured against the bight portion by a bracket 118 and includes a lower tapered end 122 adapted to urge the cam 110 inwardly as the wedge 112 is moved downwardly (FIG. 4). The upper end of the wedge 112 is secured to a cable 126 which in turn is supported at one end by a bracket 128 connected to the upper end of the member 86. The cable 126 is enclosed in a sheath 132 and extends upwardly and rearwardly along the mast 22 to a location adjacent an operator station 134 on the tractor 10. A knob 136 is connected to the operator end of the cable 126 so that the cable may be extended and retracted to rotate the cam 110 between its locked and unlocked positions. A knob lock 137 (FIG. 2) prevents movement of the cable to lock the wedge 112 against upward movement during loader operations. A mechanical linkage may be substituted for the cable 126 to provide remote control of the wedge 112.

As best seen in FIGS. 2, 4 and 5, a substantial portion of the locking structure 84 is part of an assembly common with the parking stand 36. Therefore, if a purchaser of a loader 20 does not wish to have the parking stand feature and the latch feature, the forward end 32 of the mast arm 28 may be connected directly to front support structure by inserting bolts through the forward end 32 (at the location where the bolts 94 are located as shown in FIG. 2) and through corresponding holes in a simplified mounting frame (not shown) connected to the forward end of the tractor frame 16.

In operation, assuming that the loader 20 is supported on the parking stand 36 and the bucket 56 with the mast posts 24 raised above the ground, the tractor 10 is first driven forwardly until the rear support 26 is below the mast post 24. The cylinders 58 are then operated to lower the posts 24 onto the supports 26. Continued retraction of the cylinders 58 rotates the mast arms 28 upwardly and the locking structure 84 approaches the mounting frame 62 (FIG. 5). The wedge 112 is in the retracted position to permit free movement of the structure 84 relative to the frame 62. Continued extension of the cylinders 58 causes the guide member 88 to move against the lower surface 98 of the stop member 68. The upper projection of the guide member 88 is thereby guided into the notch 106, and the stop member 68 prevents further upward rotation of the mast arms 28 once the cam 110 is located adjacent the cavity 78. At this point, the operator pushes the knob 136 to slide the wedge 112 against the cam 110, which rotates the cam in the clockwise direction (FIG. 4) into the cavity to lock the mast arm in position. Therefore, once the hydraulic lines are connected to the loader 20, the operator can attach the loader without leaving his tractor seat.

To detach the loader from the tractor, the operator pulls back on the knob 136 to slide the wedge 112 away from the cam 110. The cam is therefore free to rotate about the pivot 116 away from the cavity 78 thereby permitting the locking structure 84 to move downwardly with respect to the front mounting frame 62. The operator extends the cylinders 58 to move the parking stand 36 downwardly into engagement with the ground. Continued extension of the cylinders lifts the mast posts 24 from the respective rear supports 26 so that the loader 20 rests on the bucket 56 and the parking stand 36. The operator then disconnects the hydraulic lines and backs the tractor 10 away from the loader 20.

ALTERNATE EMBODIMENT

In the embodiment shown in FIGS. 6–10, the front support structure **34*a* includes a guide member 88*a* connected to the front mounting frame 62*a*. Mating bracket structure 148 is connected to the forward end 32*a* by a bolt 150. A parking stand 36*a* includes side legs 38*a* connected to the respective bracket structure 148. A bight portion (not shown) connects the lower ends of the side legs 38*a*. Each side leg 38*a* angles outwardly at location 152 and extends upwardly at 154 to define the outermost wall of the mounting structure 148. A plate 156 is welded to the location 152 and to the outer wall 154. An angle 158 is welded to the aft edge of the wall 154 and extends inwardly therefrom to a forwardly directed flange 160 (FIG. 7) which is slidably received within a notch 164 located in the member 88*a* adjacent the outer face of the mounting frame 62*a*. A cylindrically shaped cam 110*a* is journalled for rotation on a pin 116*a* which extends through the plate 156 and the angle 158 (FIG. 7). A sleeve 170 is positioned over the pin 116*a* between the angle 158 and the cam 110*a*. A cam receiving area or cavity 78*a* is located in the guide member 88*a*. A cable bracket 128*a* is connected to the upper end of the wall 154 and supports a cable 126*a* which is routed along the loader to a position adjacent the operator's station 134 as shown in FIG. 1. A cam 112*a* is slidably mounted within the bracket structure 148 adjacent the inside surface of the wall 154. The wedge 112*a* is connected to the cable 126*a* for movement between a locking position (FIG. 6) wherein the cam 110*a* is urged into the cavity 78*a* and a release position (FIG. 9) wherein the wedge 112*a* is slid upwardly by the cable 126*a* to a location wherein the cam 110*a* is free to rotate outwardly toward the wall 154 away from the cavity 78*a*. A U-shaped spring clip 174 includes an upper bight portion located above the top surface of the wedge 112*a*. The lower portion of the clip 174 is bent inwardly toward the cam 110*a* and includes projections 176 which are inserted into corresponding holes in the cam 110*a* which are offset downwardly and outwardly from the axis of the pin 116*a*. As the wedge 112*a* is lifted (FIG. 9) the top of the wedge contacts the bight portion of the clip 174 and urges the clip upwardly to pull the cam 110*a* toward the wall 154. The wedge 112*a* is free to slide downwardly from the bight portion on the clip 174 when the wedge is moved toward the locking position (FIG. 6**).

The member **88*a* includes a stop indicated generally at 180 located above and to one side of the cavity 78*a*. A threaded projection 182 extends outwardly from the member 88*a* and an adjusting bolt 184 is threaded through the projection. A locking nut 186 is tightened against the projection 182 to secure the bolt 184 in the preselected adjusted position. As the forward end 32*a* of the mast is raised into position, the lower end of the bolt 184 contacts the bracket structure 148 to prevent upward movement of the mast beyond the location wherein the cam 110*a* is aligned with the cavity 78*a* (FIG. 6**).

In operation, the mast 22 is rotated about the rear supports 26. As the forward end of the mast **32*a* approaches the mounted position, the flange 160 of the angle 158 is guided into the notch 164. The operator continues to raise the forward end 32*a* until the bracket structure 148 contacts the stop 180. The operator from his tractor seat then moves the knob on the operator end of the cable 126*a* to force the wedge 112*a* against the cam 110*a*. The wedge 112*a* forces the cam 110*a* into the cavity 78*a* (FIG. 6) to lock the forward end 32*a* of the mast in position on the tractor frame 16**.

Figure 9:
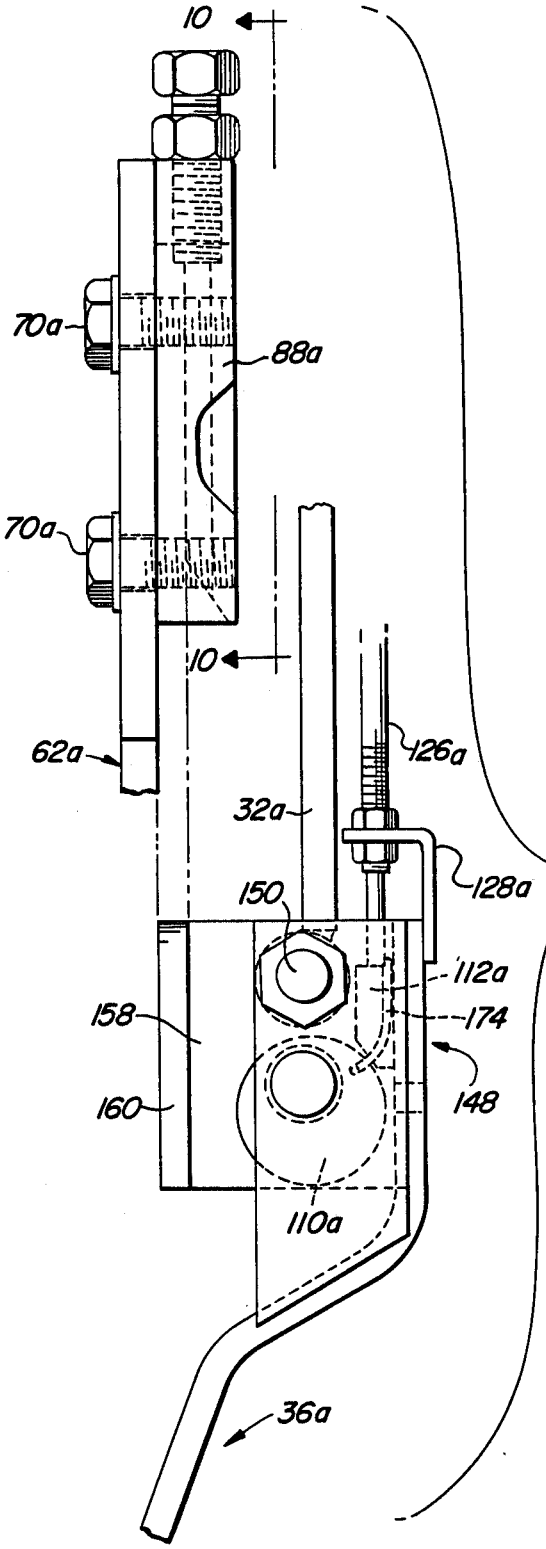
FIG. 9 is a front view similar to FIG. 6 but showing the cam in the released position with the forward end of the mast arm below the upwardmost rocked position.
Figure 10:
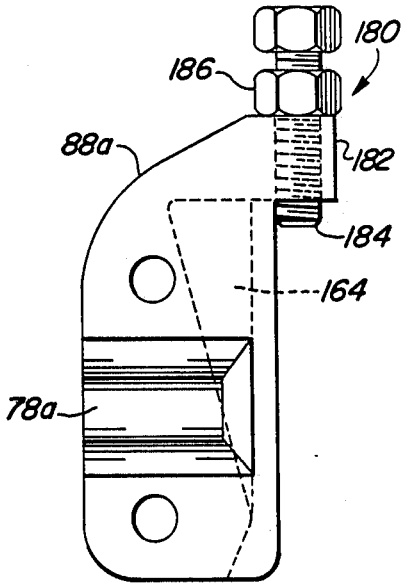
FIG. 10 is a view taken substantially along lines 10—10 of FIG. 9.

To remove the loader from the tractor frame, the operator pulls the knob of the cable **126*a* to slide the wedge 112*a* upwardly away from the cam 110*a* (FIG. 9). The spring clip 174 pulls the cam 110*a* from the cavity 78*a* (FIG. 9) so that the forward end of the mast 32*a* is free to move downwardly away from the member 88*a***.

As best seen in FIGS. 6 and 8, the mating bracket structure 148 and the parking stand **36*a* may be removed from the forward end 32*a* simply by removing the bolt 150, which connects the bracket structure 148 to a cylindrical member 190 welded to the bottom of the end 32*a*. Therefore, if a farmer does not wish to have the parking stand and remotely operable locking feature, he may connect the end 32*a* directly to a simplified bracket (not shown) mounted on the tractor frame 16**.

Having described the preferred embodiment, it will be apparent that modifications can be made without departing from the scope of the invention as defined in the accompanying claims.

We claim:

1. In a loader including a mast post adapted for connection to a tractor having a fore-and-aft extending frame and an operator's station, and mast extending forwardly from the mast post, said mast rockable about the mast post connection between a lowered storage position and a raised mounted position, releasable connecting structure for selectively locking and unlocking the forward end of the mast with respect to the tractor frame from the operator's station, said connecting structure including:

a front mounting frame;

means for connecting the mounting frame to the forward end of the tractor frame;

mating bracket structure connected to the mast;

means for guiding the mating bracket structure into engagement with the front mounting frame as the mast is rocked upwardly to the mounted position, said means for guiding including means for restricting forward movement of the mast as tthe mast approaches the mounted position; and means locking the front mounting frame and mating bracket structure in the engaged position for securing the mast to the tractor frame, said means locking including a cam rockably connected to the mating bracket structure, a cam-receiving area located on the mounting frame, and remote control means located adjacent the operator's station for selectively rocking the cam, when the mast is in the mounted position, between a latching position wherein the cam is positioned in the cam-receiving area and an unlatching posittion wherein the cam is offset from the cam-receiving area.

2. The invention as set forth in claim 1 wherein the means for rocking the cam includes a wedge supported on the mating bracket structure adjacent the cam and movable against the cam, said remote control means being connected to the wedge for moving the wedge.

3. The invention as set forth in claim 1 wherein the cam includes an engaging portion having a shape complementary to the cam-receiving area, and means rotatably connecting the cam to the mating bracket structure for rotation about an axis offset from the engaging portion for rocking the engaging portion into and out of the cam-receiving area.

4. The invention as set forth in claim 3 wherein the means for rocking the cam includes wedge means movable against the cam for rotating the cam about the cam axis.

5. In a loader including a mast adapted for connection to a tractor having a fore-and-aft extending frame and an operator's station, said mast movable between a lowered storage position and a raised mounted position, releasable connecting structure for selectively locking and unlocking the mast with respect to the tractor frame, said connecting structure including:

a bracket;

means for connecting the bracket to the tractor frame;

mating bracket structure connected to the mast;

means for guiding the bracket and mating bracket structure into engagement as the mast is moved to the mounted position; and means locking the bracket and mating bracket structure in the engaged position for securing the mast to the tractor frame, said means locking including a cam having a substantially cylindrical portion, and means rockably connecting the cam to the mating bracket structure for rocking about an axis offset from the axis of the cylindrical portion, a cam-receiving cavity connected to the bracket, and means for selectively rocking the cam into the cavity when the mast is in the mounted position including wedge means movable against the cam for rocking the cam about the cam axis and cable means connected to the wedge means and extending along the mast to a position adjacent the operator's station.

6. The invention as set forth in claim 3 wherein the mating bracket structure is selectively attachable to and removable form the mast.

7. The invention as set forth in claim 6 further including a parking stand connected to the mating bracket structure and selectively attachable to and removable form the mast with the mating bracket structure.

8. The invention as set forth in claim 1 wherein the means for guiding includes means for preventing upward and lateral movement of the mast when in the mounted position, and wherein the cam when rocked into the cavity prevents movement in a second direction generally perpendicular to the first direction.

9. The ineention as set forth in claim 1 wherein the means for guiding includes abutment means for preventing he mast from rocking upwardly beyond the mounted position.

10. In a loader including a mast adapted for connection to a tractor having a fore-and-aft extending frame and an operator's station, said mast including rear mast posts and mast arms extending forwardly from the posts, rear support structure for supporting the mast posts on the frame, and means for rocking the mast arms about the rear support structure between a lowered storage position and a raised mounted position, releasable connecting structure for selectively locking and unlocking the mast arms to the forward end of the frame, said connecting structure including:

a tractor bracket connected to the forward end of the frame and including a cam-receiving area and a mast arm guide member;

a cam member having a cam portion adapted for receipt in the cam-receiving area and pivotally connected to one of the mast arms for rocking about an axis offset from the cam portion at a location which when the mast arms are in the raised position is adjacent the bracket;

guide means located on said one of the mast arms and rockable therewith into engagement with the guide member for securing the mast arm laterally with respect to the tractor frame as the mast arm is rocked upwardly; and means for moving the cam to a latching position into the cam-receiving area when the mast arms are in the raised position to secure the mast arms against downward and forward movements relative to the frame, said means for moving including linkage, means extending between the cam memer and the operator's station for rocking the cam member from the station.

11. In a loader including a mast adapted for connection to a tractor having a fore-and-aft extending frame and an operator's station, said mast including rear mast posts and mast arms extending forwardly from the posts, rear support structure for supporting the mast posts on the frame, and means for rocking the mast arms about the rear support structure between a lowered storage position and a raised mounted position, releasable connecting structure for selectively locking and unlocking the mast arms to the forward end of the frame, said connecting structure including:

a tractor bracket connected to the forward end of the frame and including a cavity;

a cam mounted on one of the mast arms at a location which when the mast arms are in the raised position is adjacent the bracket;

a mast arm bracket connected to said one of the mast arms;

means for moving the cam to a latching position into the cavity when the mast arms are in the raised position to secure the mast arms to the forward end of the frame;

wherein said cam includes a rounded camming portion, means pivotally connecting the cam to the mast arm bracket for rocking about an axis offset from the rounded camming portion between an inward unlatching position and an outward latching position, wherein in the unlatching position the mast arms are free to move with respect to the tractor bracket and wherein the means for moving includes positionable actuator means located adjacent the cam for selectively rocking the cam into the cavity and for releasing the cam from the cavity when the mast is in the raised position; and wherein the mast arm bracket includes a wall portion offset from the cam and the actuator means includes a wedge slidable between the wall portion and cam for rocking the cam into the cavity.

12. The invention as set forth in claim 11 wherein the wedge is movable between a first position corresponding to the unlatching position and a second position corresponding to the latching position, wherein in the second position the wedge prevents rocking movement of the cam away form the cavity.

13. The invention as set forth in claim 12 wherein the actuator means further includes remotely operable cable means connected to the wedge for sliding the wedge between the first and second positions.

14. In a loader including a mast adapted for connection to a tractor having a fore-and-aft extending frame and an operator's station, said mast including rear mast posts and mast arms extending forwardly from the posts, rear support structure for supporting the mast posts on the frame, and means for rocking the mast arms about the rear support structure between a lowered storage position and a raised mounted position, releasable connecting structure for selectively locking and unlocking the mast arms to the forward end of the frame, said connecting structure including:

a tractor bracket connected to the forward end of the frame and including a cavity;

a cam mounted on one of the mast arms at a location which when the mast arms are in the raised position is adjacent the bracket;

a mast arm bracket connected to said one of the mast arms;

means for moving the cam to a latching position into the cavity when the mast arms are in the raised position to secure the mast arms to the forward end of the frame;

wherein said cam includes a rounded camming portion, means pivotally connecting the cam to the mast arm bracket for rocking about an axis offset from the rounded camming portion between an inward unlatching position and an outward latching position, wherein in the unlatching position the mast arms are free to move with respect to the tractor bracket and wherein the means for moving includes positionable actuator means located adjacent the cam for selectively rocking the cam into the cavity and for releasing the cam from the cavity when the mast is in the raised position; and wherein the pivotal axis of the cam extends in the fore-and-aft direction when the mast arms are in the raised position, said cam securing the mast arm in the mast arm in the downward direction, and wherein the tractor and mast arm brackets include complementary guiding means for securing the mast arm laterally with respect to the tractor frame as the mast is rocked to the raised position.

15. The invention as set forth in claim 13 wherein the guiding means includes stop means for securing the mast arm against upward rotation beyond the position wherein the cam is aligned with the cavity.

16. The invention as st forth in claim 10 further including a parking stand mounted on the forward end of the mast arm and means for supporting the cam member on the parking stand.

17. The invention as set forth in claim 16 including means for releasably securing the parking stand to the mast arms.

18. The invention as set forth in claim 11 wherein the means operably connecting comprises a spring clip connected to the cam.

* * * * *

UNITED STATES PATENT AND TRADEMARK OFFICE

CERTIFICATE OF CORRECTION

PATENT NO. : 4,780,046

DATED : October 25, 1988

INVENTOR(S) : Henry Friesen et al

It is certified that error appears in the above-identified patent and that said Letters Patent is hereby corrected as shown below:

Claim 1, line 3, before "mast" insert -- a --; claim 1, column 7, line 2, change "tthe" to -- the --; and same claim and column, line 14, change "posittion" to -- position --.

Claim 6, line 3, change "form" to -- from --.

Claim 7, line 4, change "form" to -- from --.

Claim 9, line 1, change "ineention" to -- invention --; and line 3, change "he" to -- the --.

Claim 10, column 8, line 40, delete the comma "," after "linkage"; same claim and column, line 41, change "memer" to -- member --.

Claim 12, line 6, change "form" to -- from --.

Claim 14, column 10, line 22, delete "in the mast arm".

Signed and Sealed this

Twenty-second Day of August, 1989

*Attest:*

DONALD J. QUIGG

*Attesting Officer*

*Commissioner of Patents and Trademarks*